US006566815B2

(12) United States Patent
Heike et al.

(10) Patent No.: US 6,566,815 B2
(45) Date of Patent: May 20, 2003

(54) REFLECTOR HIGH-PRESSURE DISCHARGE LAMP UNIT

(75) Inventors: Florian Heike, München (DE); Sven Schalk, Hockenheim (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 09/936,369

(22) PCT Filed: Jan. 12, 2001

(86) PCT No.: PCT/DE01/00147

§ 371 (c)(1),
(2), (4) Date: Dec. 6, 2001

(87) PCT Pub. No.: WO01/52298

PCT Pub. Date: Jul. 19, 2001

(65) Prior Publication Data

US 2002/0158581 A1 Oct. 31, 2002

(30) Foreign Application Priority Data

Jan. 14, 2000 (DE) ..... 100 01 544

(51) Int. Cl.[7] ..... H05B 37/00
(52) U.S. Cl. ..... 315/56; 315/71; 313/113
(58) Field of Search ..... 315/56, 58, 71, 315/72; 313/113

(56) References Cited

U.S. PATENT DOCUMENTS

| | | | | |
|---|---|---|---|---|
| 3,138,731 A | | 6/1964 | Beese | |
| 3,364,374 A | | 1/1968 | Wilson | |
| 4,290,097 A | | 9/1981 | Block et al. | |
| 4,423,348 A | | 12/1983 | Greiler | |
| 4,774,636 A | | 9/1988 | Gaugel et al. | |
| 5,604,406 A | * | 2/1997 | Gaus | 315/56 |
| 5,621,267 A | | 4/1997 | Shaffner et al. | |

FOREIGN PATENT DOCUMENTS

WO 0 374 846 6/1990

* cited by examiner

*Primary Examiner*—David Hung Vu
(74) *Attorney, Agent, or Firm*—Frishauf, Holtz, Goodman & Chick, P.C.

(57) ABSTRACT

The reflector high-pressure discharge lamp unit has a reflector (2), a high-pressure discharge lamp (3) arranged on the axis of the reflector (2), a first base part (4) connected to the neck (16) of the reflector (2), and a second base part (5), arranged in front of the radiation/light exit opening of the reflector (2) and in the form of a mechanical auxiliary part. The end of the second supply lead (18), led to the second lamp shank (10), of the high-pressure discharge lamp (3) is electrically connected directly to the end of the second high-voltage cable (7), and this free connecting region is embedded in the second base part (5). The result of this is a high degree of shock resistance and strain relief with this lamp connection.

16 Claims, 2 Drawing Sheets

REFLECTOR HIGH-PRESSURE DISCHARGE LAMP UNIT

This application is a U.S. National Phase Application under 35 USC 371 of International Application PCT/DE01/00147 (not published in English) filed Jan. 12, 2001.

TECHNICAL FIELD

The invention relates to a reflector high-pressure discharge lamp unit in accordance with the features of the preamble of claim 1.

PRIOR ART

Such a reflector high-pressure discharge lamp unit is disclosed in DE 30 33 688. In this case, a high-pressure discharge lamp and a reflector are permanently connected as an assembly. An electrically insulating first base part is connected to the reflector neck and the lamp, and a second base part, which consists of ceramic and takes the form of a ring, is connected to the light-emitting exit opening of the reflector. The supply lead connected to the end of the lamp situated in the light-exit direction is constructed as a metal band or welded to a metal band running over the cross section. The metal band ends in a free-standing, metallic contact pin, which is fastened on the ring of the base part and serves to make electric contact with the lamp by means of a high-voltage cable.

Furthermore, U.S. Pat. No. 5,506,464 describes a closed reflector discharge lamp arrangement in which the supply lead of the first lamp shank of the discharge lamp, which is arranged with its longitudinal axis on the axis of the reflector, is electrically connected to a first base part made from metal. The end of the first lamp shank is fastened by means of cement in the reflector neck, together with the first base. The supply lead of the end of the lamp shank situated in the light-exit direction is guided outward through the reflector and electrically connected to a free-standing, metallic contact angle fastened on the reflector.

The above-named reflector discharge lamps are preferably used in video and data projectors, that is to say in projection devices in which liquid crystals or DMDs (DMD™=Digital Mirror Device from Taxas Instruments) are used as light valves. Most recently, it has been chiefly what are termed "ultracompact" projectors that have been gaining importance here, and in these a high degree of portability is ensured owing to their small external dimensions and compact design, in conjunction with their low weight. High-pressure discharge lamps which are employed in the reflector lamps used require a high-voltage pulse of a few kV for starting, and even several tens of kilovolts in the case of hot starting. Consequently, not only must the two lamp connections be adequately insulated electrically from one another, but the electric connections of the lamp arrangement must also be adequately insulated electrically from the housing part of the projection unit in order to exclude a potential risk to the user, and in order to avoid a short circuit to earth, which could entail destruction of electronic components of the projection unit. In the case of the frequently used, advantageous symmetrical starting, this holds for both electric connections of the lamp, although there is problem, in particular, with the lamp connection of the end of the lamp shank situated in the light-exit direction, since here the diameter of the reflector, and thus also of the overall arrangement, is substantially larger than the diameter of the reflector neck or of the first base. In order to ensure the electrical insulation of the electric connections of the lamp from the housing of the projection unit, it is necessary either to observe appropriately large spacings inside the unit, which conflicts with the desired compactness, or there must be more outlay in the form of additional electric insulations.

SUMMARY OF THE INVENTION

It is therefore the object of the present invention to create a reflector high-pressure discharge lamp unit of the generic type in a compact design for use in projection units, in the case of which the shock resistance of the lamp connection of the end of the lamp shank situated in the light-exit direction is ensured in a simple way and the required strain relief of the high-voltage cable is simultaneously created.

The object is achieved by means of the characterizing features of claim 1. Further advantageous refinements of the reflector high-pressure discharge unit are to be gathered from the subclaims.

The required strain relief and high-voltage insulation are achieved by the direct connection of the end of the second supply lead or of the connecting line to the second supply lead to the end of the second high-voltage cable, and the embedding of this connecting region in the second base part, designed as a mechanical auxiliary part, made from electrically non-conducting material.

It is advantageous in this case that the end of the second supply lead or the connecting line to the second supply lead is directly soldered and welded to the end of the second high-voltage cable. Moreover, the end of the second high-voltage cable is embedded in a bore in the edge of the second base part. In order to achieve a still higher degree of high-voltage insulation, the second base part can have a cylindrical appendage on the edge in the region of the bore in order to lengthen the bore. Consequently, a larger section of the end of the high-voltage cable surrounded by insulation can be embedded in the bore, resulting in the achievement of a further increase in the shock resistance. This encapsulation of the connecting point by the high-voltage cable and supply lead or connecting line ensures that at the required high voltages no free-standing metal parts are exposed which could lead to a direct high-voltage flashover (air spark), and all leakage paths are long enough to exclude a surface discharge which could develop into a high-voltage flashover. Selecting the wall thickness of the auxiliary part made from electrically non-conducting material in accordance with the required high voltage additionally prevents high-voltage breakdown, and so when installing the reflector high-pressure discharge lamp unit according to the invention in a projection unit, there is no need to observe any special insulating spacings, nor are additional electric insulations required.

In order to achieve the desired strain relief of the high-voltage cable, the diameter of the bore in the cylindrical appendage should advantageously be equal to, or only slightly larger than, the diameter of the insulating part of the high-voltage cable.

The end of the supply lead remote from the reflector neck, or the end of the connecting line of the supply lead remote from the reflector neck from the end of the bulb shank of the high-pressure discharge lamp to the second base part is advantageously guided in a shockproof groove in the region of the second base part.

In order to be able to introduce the end of the high-voltage cable and the end of the second supply lead or the end of the connecting line into the bore or groove on the second base part in the connected state, the cylindrical appendage is advantageously provided in the region of the bore with a slot which runs parallel to the bore and reaches up to the groove.

The high-voltage cable can also advantageously be fixed in the bore by means of a screw made from insulating material, in order to achieve an even higher degree of strain relief.

In this case, the bore advantageously runs parallel to the axis of the high-pressure discharge lamp, and thus also parallel to the axis of the reflector. This keeps as small as possible the space required in the projection unit for the reflector high-pressure discharge lamp unit.

In order to pass radiation/light, the second base part, designed as an auxiliary part, respectively has an aperture on the side respectively facing and averted from the radiation/light exit of the reflector. It is advantageously permanently connected to the reflector. For reasons of safety, the second aperture of the auxiliary part is advantageously sealed with a face-plate transparent to radiation/light. This prevents combustible objects from touching hot lamp parts. In the case of an explosion of the high-pressure discharge lamp, this face-plate, in addition, protects sensitive optical components in the unit from damage. Moreover, the face-plate constitutes an additional electrical insulation of the end of the second lamp shank of the discharge lamp situated in the light-exit direction, and the supply lead thereof, and so the overall length in the light-exit direction can be kept compact. The face-plate can be fastened on the auxiliary part with the aid of an adhesive, for example a silicone adhesive, or be held in position mechanically by clamps or a ring.

If required, the auxiliary part can additionally be provided with one or more lateral openings in order to use a specifically controlled air flow to cool thermally critical sites such as, for example, the end of the second lamp shank of the discharge lamp situated in the light-exit direction, in the case of combination with an elliptical reflector.

A precisely adjusted installation of the lamp in an optical unit, in particular a video and/or data projector, is advantageously facilitated by fitting reference points and threaded holders on the second base part.

If the second base part designed as auxiliary part is produced from an injection moldable high-temperature plastic, this has the advantage by comparison with other materials such as, for example, ceramics that a high measure of flexibility exists with reference to the configuration of the geometrical shape of the auxiliary part, and that a lower weight is achieved. The use of glass fiber reinforced plastic additionally advantageously enhances the mechanical stability of the auxiliary part. The material PEEK™ (polyether ether ketone) has proved to be particularly advantageous as injection moldable high-temperature material, since it has a very high thermostability and a good UV compatibility.

BRIEF DESCRIPTION OF THE DRAWING

The aim below is to explain the invention in more detail with the aid of an exemplary embodiment. In the drawing.

DETAILED DESCRIPTION OF THE DRAWINGS

Figure 1:
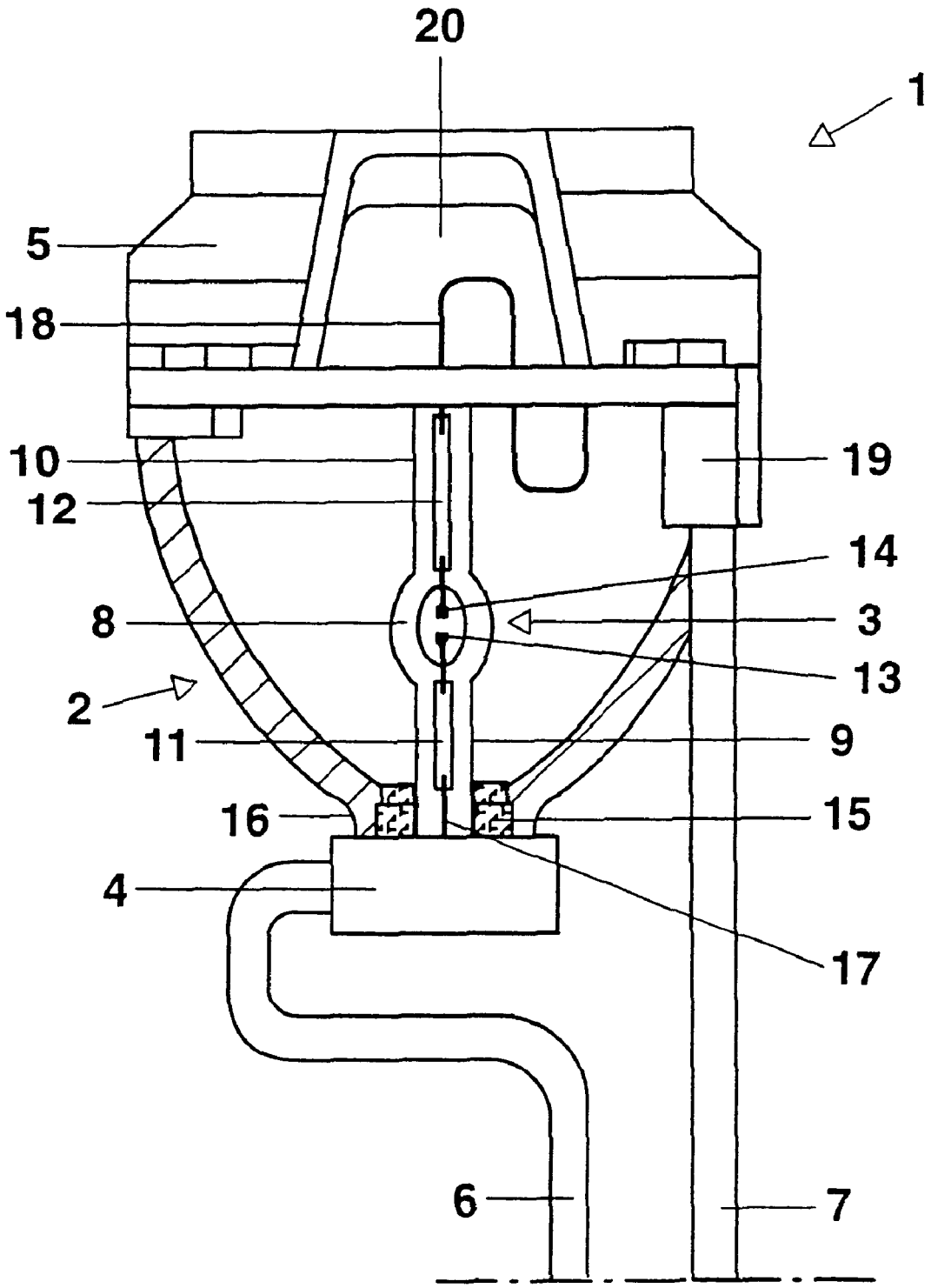
FIG. 1 shows a partially cut-away reflector high-pressure discharge lamp unit according to the invention.

The reflector high-pressure discharge lamp unit 1 according to the invention has a coated reflector 2 made from pressed glass with an elliptical reflector shape, a short-arc high-pressure discharge lamp 3 with a filling made from mercury halides and at least one inert gas, as well as base parts 4, 5 and high-voltage cables 6, 7. The high-pressure discharge lamp 3 is composed of a lamp bulb 8 and two lamp shanks 9, 10 arranged on the two opposite ends of the lamp bulb 8, electrode systems 13, 14 being sealed in a gastight fashion in the lamp shanks 9, 10 via metal foils 11, 12. The short-arc high-pressure discharge lamp 3 is arranged with its axis on the axis of the reflector 2 and fastened with its first lamp shank 9 in the neck 16 of the reflector 2 by means of a cement 15.

The first base part 4, made from non-conducting plastic, is fastened on the free end of the reflector neck 16 and the first lamp shank 9 fastened therein. The metal foil 11 in the first lamp shank 9 is electrically connected via a first supply lead 17 to the contacting system (not illustrated here) in the first base part 4. Connected in turn to this contacting system is the first 6 of the two high-voltage cables 6, 7, via which the reflector high-pressure discharge lamp unit 1 is connected to an electronic starting and operating system.

The metal foil 12 in the second lamp shank 10 is connected with one end to a second supply lead 18. The other end of this second supply lead 18 is electrically connected in turn to the second high-voltage cable 7 and, according to the invention, embedded in an appendage 19 at the edge of the second base part 5. Details of this connection are shown in the following figures.

This second base part 5, likewise made from non-conducting plastic, takes the form of an auxiliary part, and is fitted in front of the radiation/light-exit opening of the reflector 2 and permanently connected to the edge thereof. The second base part 5 has lateral ventilation openings 20 and a face-plate (not illustrated here) transparent to radiation and light.

Figure 2A:
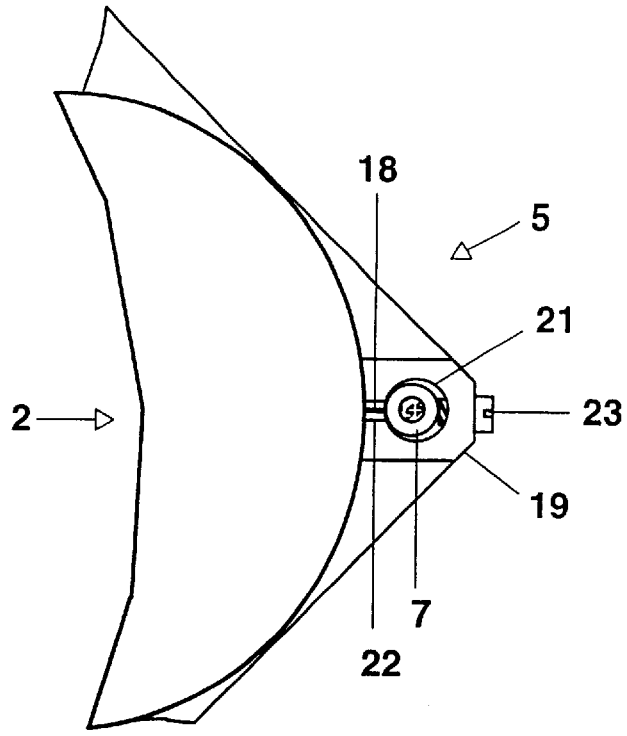
FIGS. 2*a* and 2*b* show a detailed plan view and a cut-away side view of an embodiment of the connection, embedded in the second base part, of the second high-voltage cable and second supply lead of the reflector high-pressure discharge lamp unit in accordance with FIG. 1.
Figure 2B:
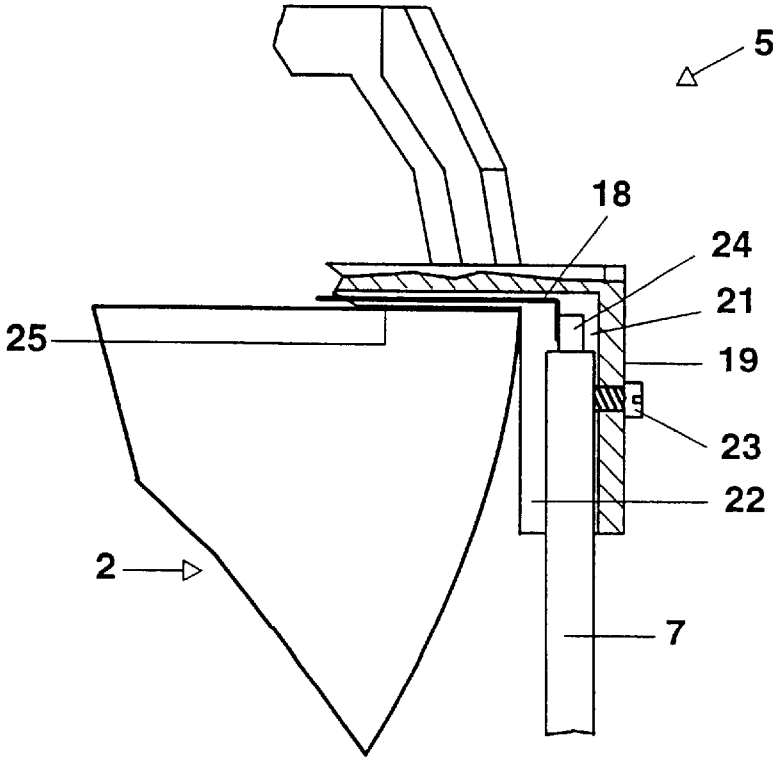

FIGS. 2*a* and 2*b* show in plan view and in a cut-away side view a design of the connection, embedded in the second base part 5, of the end of the second supply lead 18 to the end of the second high-voltage cable 7.

The edge of the second base part 5 has for this purpose an appendage 19 with a bore 21 parallel to the lamp and reflector axis. The appendage 19 is provided with a slot 22 parallel to the bore 21. The bore 21 has a diameter which is equal to the diameter of the insulated part of the high-voltage cable 7. The end of the high-voltage cable 7 is retained in the bore 21 by clamping. The end of the high-voltage cable 7 is additionally fixed in the bore 21 by means of a screw 23 made from insulating material. The high-voltage cable 7 has a bared tip 24 which is welded to the end of the second supply lead 18. The end region of the supply lead 18 is embedded, in a shockproof fashion, in turn, in a groove 25 on the side of the second base part 5 facing the reflector 2. The bore 21 and the slot 22 reach up to and including the level of the groove 25. It is possible thereby for the end of the second supply lead 18 to be introduced, together with the end of the second high-voltage cable 7, in the welded state into the groove 25 or the bore 21, and subsequently to connect the second base part 5 permanently to the reflector 2. This leads to a high degree of shock resistance of the lamp.

What is claimed is:

1. A reflector high-pressure discharge lamp unit (1) for applications in the fields of radiation and illuminating engineering, in particular for applications in the field of projection, comprising:

a reflector (2) with a reflector neck (16), and having a radiation/light exit opening and an axis, a high-pressure discharge lamp (1) arranged on the axis of the reflector (2) and having a lamp bulb (8) and two lamp shanks (9, 10) which are arranged at the two opposite ends of the lamp bulb (8) and into which electrode systems (13, 14) are sealed in a gastight fashion via metal foils (11, 12), one lamp shank (9) being fastened in the reflector neck (16), a first base part (4) made from a non-conducting material and connected to the reflector neck (16), a second base part (5), arranged in front of the radiation/light exit opening of the reflector (2) and in the form of a mechanical auxiliary part made from non-conducting material, first and second supply leads (17, 18), of which one end is electrically connected to the metal foils (11, 12) in the lamp shanks (9, 10), and the other end is guided directly or via a connecting line to the first base part (4) or second base part (5), and first and second high-voltage cables (6, 7) for connecting the high-pressure discharge lamp (1) to a starting device and ballast, which are electrically connected to the supply leads (17), characterized in that the end of the second supply lead (18), led to the second base part (5), or the end of the connecting line is electrically connected directly to the end of the corresponding second high-voltage cable (7), and this free connecting region is embedded in the second base part (5).

2. The reflector high-pressure discharge lamp unit as claimed in claim 1, characterized in that the end of the second supply lead (18) or connecting line led to the second base part (5) is directly soldered or welded to the end of the second high-voltage cable (7).

3. The reflector high-pressure discharge lamp unit as claimed in claim 1, characterized in that the end of the second high-voltage cable (7) is embedded in a bore (21) in the edge of the second base part (5).

4. The reflector high-pressure discharge lamp unit as claimed in claim 3, characterized in that on the edge the second base part (5) has, in the region of the bore (21), a cylindrical appendage (19) for lengthening the bore (21).

5. The reflector high-pressure discharge lamp unit as claimed in claim 3, characterized in that the bore (21) runs parallel to the high-pressure discharge lamp axis in the edge of the second base part (5).

6. The reflector high-pressure discharge lamp unit as claimed in claim 3, characterized in that the second high-voltage cable (7) is fixed in the bore in the edge of the second base part (5) by means of a screw made from insulating material.

7. The reflector high-pressure discharge lamp unit as claimed in claim 3, characterized in that the diameter of the bore (21) in the edge of the second base part (5) is less than or equal to the diameter of the insulated part of the second high-voltage cable (7).

8. The reflector high-pressure discharge lamp unit as claimed in claim 1, characterized in that the end of the second supply lead (18), led to the second base part (5), or the end of the connecting line in the region of the second base part (5) is guided in a shockproof groove (25).

9. The reflector high-pressure discharge lamp unit as claimed in claim 8, characterized in that the end of the second high-voltage cable (7) is embedded in a bore (21) in the edge of the second base part (5), and the cylindrical appendage (19) on the edge of the second base part (5) has a slot (22) which runs parallel to the bore (21) and reaches up to the groove (25).

10. The reflector high-pressure discharge lamp unit as claimed in claim 1, characterized in that the second base part (5) has a first aperture on the side facing the radiation/light exit opening of the reflector (2).

11. The reflector high-pressure discharge lamp unit as claimed in claim 10, characterized in that the second base part (5) has a second aperture on the side averted from the radiation/light exit opening of the reflector (2).

12. The reflector high-pressure discharge lamp unit as claimed in claim 1, characterized in that the second base part (5) is permanently connected to the edge of the reflector (2).

13. The reflector high-pressure discharge lamp unit as claimed in claim 11, characterized in that the second aperture fitted on the second base part (5) is sealed by a face-plate transparent to radiation and light.

14. The reflector high-pressure discharge lamp unit as claimed in claim 1, characterized in that the second base part (5) has one or more lateral ventilation openings (20).

15. The reflector high-pressure discharge lamp unit as claimed in claim 1, characterized in that reference points and threaded holders for the installation of
the reflector high-pressure discharge lamp unit permanently in an aligned fashion are fitted on the second base part (5).

16. The reflector high-pressure discharge lamp unit as claimed in claim 1, characterized in that said first and second base parts (4, 5) consist of a high-temperature plastic.

* * * * *